United States Patent [19]

Baker et al.

[11] 4,431,489

[45] Feb. 14, 1984

[54] COLORING PROCESS FOR ANODIZED ALUMINUM PRODUCTS

[75] Inventors: Bernard R. Baker; Richard L. Smith, both of Pleasanton; Perce W. Bolmer, San Ramon, all of Calif.

[73] Assignee: Kaiser Aluminum & Chemical Corporation, Oakland, Calif.

[21] Appl. No.: 480,965

[22] Filed: Mar. 31, 1983

[51] Int. Cl.[3] ..... C25D 11/22

[52] U.S. Cl. ..... 204/35 N; 204/42

[58] Field of Search ..... 204/35 N, 38 A, 42

[56] References Cited

U.S. PATENT DOCUMENTS

| | | | |
|---|---|---|---|
| 3,616,309 | 10/1971 | Asada | 204/58 |
| 3,788,956 | 1/1974 | Patrie et al. | 204/35 N |
| 3,929,612 | 12/1975 | Yanagida et al. | 204/35 N |
| 3,963,591 | 6/1976 | Zweifel et al. | 204/35 N |
| 3,977,948 | 8/1976 | Martinez | 204/35 N |
| 4,115,212 | 9/1978 | Patrie et al. | 204/38 E |
| 4,251,330 | 2/1981 | Sheasby et al. | 204/35 N |

*Primary Examiner*—Winston A. Douglas
*Assistant Examiner*—William Leader
*Attorney, Agent, or Firm*—Edward J. Lynch

[57] ABSTRACT

The invention relates to an electrolytic method of coloring anodized aluminum workpieces in an acidic aqueous electrolyte containing nickel sulfamate in amounts from 50 to 150 grams per liter (expressed as nickel) at temperatures above 35° C. The coloring voltage ranges from 5 to 40 volts (AC).

12 Claims, 1 Drawing Figure

COLORING PROCESS FOR ANODIZED ALUMINUM PRODUCTS

BACKGROUND OF THE INVENTION

Figure 1:
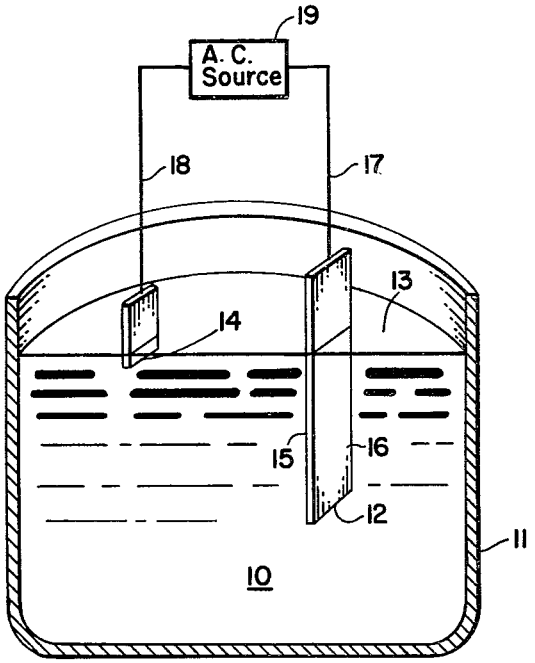

This invention generally relates to the process of forming a colored oxide coating on an aluminum workpiece wherein the aluminum workpiece is first anodized to form a porous oxide coating and then is subjected to electrolysis in an aqueous bath containing coloring agents which are deposited into the porous coating during electrolysis. The first process of this general type to be commercially used to any significant extent was the process described by Asada in U.S. Pat. No. 3,382,160. In this process the aluminum workpiece is first anodized in an aqueous sulfuric acid electrolyte to form a porous anodic oxide coating and then subsequently electrolytically treated in an acidic aqueous bath containing metal salts such as the soluble salts of nickel, cobalt, iron and the like to generate the color by precipitating metal from solution into the porous oxide coating. The more metal that is incorporated into the oxide layer, the darker the anodic coating becomes.

Many modifications to this basic process have been made over the years which include adding various metallic salts, boric acid and magnesium sulfate to the electrolytic bath. Both alternating and direct currents have been employed. The basic process has been widely used because it has been found to be less costly to operate than color anodizing processes wherein the color is generated within the anodic oxide coating as the coating is formed in the anodizing process. Other references which typically illustrate the state of the prior art relating to the basic process include U.S. Pat. Nos. 4,251,330 (Sheasby), 3,616,309 (Asada et al) 3,674,563 (Asada) and 3,788,956 (Patrie et al).

Although successful, this process generally has significant color control problems from the standpoint of generating a uniform color across the surface of the workpiece and from the standpoint of matching the color of workpieces which are sequentially treated in the same bath and workpieces which are electrolytically treated in separate baths. These difficulties were in large part caused by the poor throwing power of the electrolyte particularly when producing the darker colors. For example, when workpieces having large planar surfaces are subjected to electrolysis the edges of the workpiece tend to be much darker than the center sections, which is commonly termed "window frame" effect. Additionally, when workpieces having complex shapes are electrolytically treated the portions of the workpiece shielded from the counter electrode tend to be incompletely coated and thus develop a much lighter color than the remainder of the workpiece.

Additionally, in many instances when electrolyzing an anodized aluminum workpiece in accordance with the basic process, the anodic oxide coating tends to spall and break away from the aluminum substrate due to the disruptive effects of the electrolyzing current on the bond between the anodic coating and the substrate. This was believed to be due in part to the effects of sodium in the electrolyte and to minimize this effect, large quantities of magnesium sulfate were frequently added to the electrolytic bath.

It is against this background the present invention was developed.

DESCRIPTION OF THE INVENTION

This invention relates to an improved process of incorporating metallic coloring agents into an anodic oxide coating previously formed on an aluminum workpiece. As used herein the term "aluminum" refers to aluminum and aluminum alloys, and numerical alloy designations refer to Aluminum Association (AA) Alloy designations.

In accordance with the process of the invention an anodized aluminum workpiece is subjected as an electrode to electrolysis with an alternating current in an acidic aqueous solution of nickel sulfamate [$Ni(SO_3NH_2)_2$], containing from about 50 to 150 g/l of nickel. The solution should also contain up to about 50 g/l boric acid and up to about 20 g/l of magnesium sulfate or an equivalent amount of other soluble magnesium salt such as magnesium carbonate. The electrolyte may also contain minor amounts of other nickel salts such as nickel sulfate. The electrolytic bath temperature is maintained at elevated levels above 35° C. (95° F.) with the preferred temperature ranging from about 45° to 65° C. (113°–150° F.). Black and very dark brown colors are most difficult to develop at bath temperature in excess of 80° C. (176° F.). The pH of the bath is maintained from about 2.0 to 5.6 and preferably from about 3.0 to 4.5.

The electrolytic process is preferably voltage controlled with the operating voltage level ranging from about 5–40 volts (AC) preferably 5 to 30 volts (AC). As a general rule the maximum AC voltage for electrolysis should be from about one-half to just slightly above the maximum voltage (usually DC) applied to the workpiece during the anodizing thereof. Preferably, the AC voltage for coloring should not exceed by more than 2 volts the maximum voltage to which the aluminum workpiece has been subjected during anodizing. As used herein the voltage refers to the drop in potential across the interface between the surface of the anodized workpiece being colored and the electrolyte. This voltage drop can be measured by placing a sensing electrode which is electrically connected to the workpiece into the bath through a high resistance voltmeter so that the sensing element is a short distance away, e.g., about one inch (2.52 cm), from the surface of the workpiece. Voltage measurements between the workpiece and the counter electrode or between buses must be appropriately adjusted to compensate for the voltage drop in the bath, across the interface of the counter electrode, in the buses and in the leads to the electrodes.

The most practical electrical control procedure for the coloring process is to increase the voltage of the cell to the desired operating level and maintaining it at that level until the desired color is obtained. With such control, the current density will decay to a lower level during processing due to the changes in the oxide coating which increase the electrical resistance of the coating. The time of electrolytic treatment varies from about 1 to about 20 minutes, depending on the color desired, with short times providing light colors and longer times providing the dark colors. Treatment times much longer than twenty minutes generally are not very economical and thus are not very desirable. Generally, darker colors are more easily obtained with higher nickel concentrations in the bath, higher bath temperatures and higher operating voltages.

The nickel component of bath is predominantly nickel sulfamate. However, substantial quantities of other soluble nickel salts such as nickel sulfate can be employed to provide the required amount of nickel in solution. However, the equivalent ratio of nickel sulfamate to nickel sulfate or other suitable nickel salt, should always exceed one, preferably two, because substantially more nickel can be brought into solution with nickel sulfamate than most other suitable nickel salts. For coloring most aluminum alloys a nickel concentration in the bath of 50 to 150 g/l is adequate. However, for forming dark colors, such as black on the 7XXX aluminum alloys and other aluminum alloys which contain substantial amounts of alloying elements, it has been found that the more effective nickel concentrations range from about 75 to 125 g/l. Additionally, with these alloys the coloring voltage ranges from about 8 to 20 volts (AC).

Other bath components include boric acid which is utilized primarily in the nature of a buffer and soluble magnesium salts to minimize spalling at lower nickel concentrations. The boric acid concentration generally ranges from about 10 to 50 g/l with a preferred concentration of about 30 to 40 g/l. Magnesium sulfate or other soluble magnesium salt such as magnesium carbonate may be used in the bath in amounts up to 20 grams per liter (as $MgSO_4$) but is usually not added to the bath until the sodium content exceeds about 45 parts per million because spalling usually does not become a problem until the sodium concentration exceeds this level. Apparently the magnesium tends to block the effects that sodium has on the bond between the barrier layer in the oxide coating and the aluminum substrate which ultimately leads to spalling. Spalling is usually not a significant problem at high nickel concentrations.

After coloring the anodic coating should be sealed in a conventional manner, such as in boiling water or a hot solution of nickel acetate.

The colors obtainable with the process of the invention range from the light golds or champagne colors through the bronzes of various color density to black. The process of the invention is particularly adapted to providing excellent uniform black colors in relatively short periods of time on aluminum alloys having a high concentration of alloying elements, such as those alloys which are used in automotive applications such as bumpers and trim.

During the operation of the electrolytic bath, the pH thereof tends to decrease due to the formation of sulfamic acid during the electrolysis. The reactions involved are generally believed to be as follows:

$$Ni^2+2e^- \rightarrow Ni \quad (1)$$

$$2H_2O+2e^- \rightarrow H_2+2OH \quad (2)$$

$$2H_2O \rightarrow 4H^+ + 4e^- + O_2 \quad (3)$$

The reactions of Equations (1) and (2) occur during the cathodic cycle and Equation (3) during the anodic cycle. The resultant pH shift in the bath may be controlled by additions of nickel carbonate, magnesium carbonate, or ammonium carbonate additions. However, nickel carbonate additions are preferred because such additions not only minimize the decrease in pH by neutralizing the sulfamic acid but they also replace the nickel which is lost from the electrolytic bath due to the precipitation thereof in metallic form into the porous anodic oxide coating and that which may be lost due to drag out. Because the nickel carbonate in essence forms nickel sulfamate when it neutralizes the sulfamic acid, it is considered as equivalent to nickel sulfamate. Sulfamate additions such as sulfamic acid or nickel sulfamate are usually needed only to replace the sulfamate which is lost from drag out or from degradation.

Surface treatments prior to anodizing may be conventional such as cleaning in an inhibited alkaline cleaner followed by etching in a 5% aqueous solution of sodium hydroxide. Treatments to provide a shiny or matte surface can also be used.

The anodized coating which is formed on the aluminum workpiece before coloring may be formed in any convenient manner. Conventional anodizing treatments may be employed in aqueous electrolytes containing, for example, sulfuric acid, oxalic acid, phosphoric acid, chromic acid and the like. Anodizing electrolytes comprising 7–30% sulfuric acid in an aqueous solution are preferred. For most practical applications the oxide thickness must be at least 0.3 mil (7.6 microns) thick and in many applications, where extensive outdoor exposure is contemplated, the minimum oxide coating thickness may be 0.75 mil (19 microns). No sealing of the oxide coating should occur before coloring. Additionally, no extensive delays should occur between anodizing and coloring.

The advantages of the process are numerous but one of the most important is a substantial improvement in the throwing power of the electrolyte. The improvement minimizes differences in color which are due to differences in the distance between the workpiece and the counter electrode. Additionally, with the present invention there is also a substantial reduction in the electrolyzing time needed to reach a particular color at a particular voltage level.

One method of determining the throwing power of the electrolyte is to measure the changes in the color density (i.e. the lightness or darkness) of the electrolytically colored workpiece as a function of the distance between the counter electrode and the surface of the workpiece during electrolysis. As the distance increases the color density of the workpiece surface decreases, i.e., it becomes lighter. A coloring electrolyte with good throwing power will characteristically show considerably less color density changes with respect to distance than an electrolyte with poor throwing power. The differences in throwing power between electrolytes is more than just a difference in the electrical resistance of the electrolytes.

Reference is made with the FIGURE which illustrates in a schematic fashion a test setup for determining the throwing power of an electrolyte. The electrolytic bath 10 is held in a beaker or container 11. A flat, anodized strip 12 of aluminum which is to be electrolytically colored, is disposed in the bath 10 perpendicular to the surface 13 thereof. A flat counter electrode 14 is positioned so that the lower end 14 is just beneath the surface 13 and close to the flat surface 15 of workpiece 12. The workpiece 12 and counter electrode 14 is electrically connected via lines 17 and 18 respectively to AC voltage source 19. The strip 12 is subjected to electrolysis in accordance, for example, with the present process. The amber reflectance of the strip 12 after electrolysis is measured along the length of side 16 of the strip which is shielded from the counter electrode 14 during electrolysis. Electrolytes with good throwing power will exhibit little change. For example, electrolytes of the invention will, depending upon the color, exhibit a maximum color change of less than 10% along the length of the strip in the above setup, whereas prior electrolytes with poor throwing power exhibit a maximum color change considerably greater than 10%, frequently more than 20%.

The invention also provides processing advantages which result from the requirement that the electrolytic bath be maintained at elevated temperatures. The evaporation rate of the bath at high temperatures is sufficiently high that the water used to rinse the drag out from the surface of the electrolytically colored workpiece can be recycled back to the bath to replenish the water lost from evaporation and thereby reclaim the nickel component in the drag out which would otherwise be lost or which would require expensive reclamation.

The following examples are given to further illustrate the invention.

EXAMPLE 1

5205 aluminum alloy sheets 4×6 inches were cleaned in an inhibited alkaline cleaner, etched for 10 minutes in a 5% sodium hydroxide solution at 55° C. to form a uniform matte finish and then anodized for 30 minutes at 15 volts in a 15% sulfuric acid solution at 22° C. The anodized sheets were electrolytically treated in an acidic aqueous solution of nickel sulfamate containing 75 grams/liter of Ni and 39 grams/liter boric acid. The bath pH was 3.5 and temperature was 50° C. The treatment times the AC voltage used in the electrolytic treatment and the colors obtained are set forth below.

| Time, min. | Voltage, AC | Color |
|---|---|---|
| 5 | 8.8 | Lt. Amber |
| 5 | 9.8 | Amber |
| 5 | 10.6 | Brown |
| 5 | 11.6 | Dark Brown |
| 8 | 13.0 | Black |

EXAMPLE 2

6063 aluminum alloy extrusions having surface areas of 0.267 $ft^2$ (248 $cm^2$) were cleaned, etched and anodized as set forth above in Example 1. The anodized extrusions were electrolytically treated in the same acidic aqueous electrolyte as Example 1 which was at the same temperature and pH. The treatment times, the AC voltage used in the electrolytic treatment and the color obtained are as set forth below.

| Time, min. | Voltage, AC | Color |
|---|---|---|
| 5 | 6.6 | Champagne |
| 5 | 7.2 | Lt. Amber |
| 5 | 8.0 | Amber |
| 5 | 9.0 | Brown |
| 5 | 9.9 | Dark Brown |
| 5 | 11.0 | Black |

EXAMPLE 3

Various shapes and sizes of 5052, 5657 and 7029 aluminum alloys used for automotive bumper stock and automotive trim were cleaned in an inhibited alkaline cleaner, etched in a sodium hydroxide bath similar to those set forth in Examples 1 and 2 and then anodized in a 17% sulfuric acidic electrolyte for 25 minutes at 10 amp/$ft^2$. The anodized aluminum workpieces were electrolytically treated in an acidic aqueous electrolyte containing 84 grams/liter Ni as nickel sulfamate and 34.7 grams/liter boric acid. The pH of the bath was maintained at 3.3 and the temperature was maintained at 50° C. The treatment times, the AC voltage used in the electrolytic treatment and the colors obtained are set forth below:

| Alloy | Time, min. | Voltage, AC | Color |
|---|---|---|---|
| 5052 | 10 | 14 | Black |
| 5657 | 10 | 14 | Black |
| 7029 | 10 | 17 | Black |

It is obvious that various modifications and improvements can be made to the invention without departing from the spirit of the invention and the scope of the appended claims.

We claim:

1. A method of electrolytically coloring an anodic oxide coating which has been previously formed on an aluminum workpiece comprising subjecting the anodized workpiece to an AC voltage of about 5 to 40 volts in an acidic aqueous solution of nickel sulfamate which has a nickel concentration of 50 to 150 grams per liter and which is maintained at a temperature of at least 35° C.

2. The method of claim 1 wherein the nickel sulfamate solution contains minor amounts of nickel sulfate.

3. The method of claim 1 wherein the pH of the nickel sulfamate solution is from about 2.0 to 5.6.

4. The method of claim 1 wherein the nickel sulfamate solution contains about 10 to 50 grams per liter of boric acid as a buffer.

5. The method of claim 4 wherein the nickel sulfamate solution contains about 30 to 40 grams per liter boric acid.

6. The method of claim 1 wherein the nickel sulfamate solution contains up to 20 grams per liter of magnesium sulfate from equivalent amount of magnesium carbonate.

7. The method of claim 3 where the pH of the nickel sulfamate solution is maintained from about 3.0 to 4.5.

8. The method of claim 1 wherein the temperature of the nickel sulfamate solution is maintained from about 35° to 65° C.

9. The method of claim 1 wherein the anodized aluminum workpiece is subjected to electrolytic coloring from about 1 to 20 minutes.

10. A method of forming a black color in an anodic oxide coating which has been previously formed on an aluminum workpiece designed for automotive applications comprising subjecting the anodized workpiece to an AC voltage from about 8 to 20 volts in an acidic aqueous solution of nickel sulfamate which has a nickel concentration of about 75 to 125 grams per liter and which has a pH from about 3.0 to 4.5 and a temperature from about 35° to 65° C. the electrolytic treatment continuing for a period sufficient to form the desired black color.

11. The method of claim 10 wherein the anodized aluminum workpiece is subjected to electrolytic treatment for less than 15 minutes.

12. The method of claim 1 wherein the AC voltage ranges from about 5 to 30 volts.

* * * * *